United States Patent [19]

Colgate

[11] 4,074,629

[45] Feb. 21, 1978

[54] BLASTING AGENT AND METHOD

[76] Inventor: Stirling A. Colgate, 122 Piedra Loop, Los Alamos, N. Mex. 87544

[21] Appl. No.: 726,183

[22] Filed: Sept. 24, 1976

Related U.S. Application Data

[63] Continuation-in-part of Ser. No. 590,489, June 25, 1975, abandoned.

[51] Int. Cl.[2] ..... F42D 1/00

[52] U.S. Cl. ..... 102/23

[58] Field of Search ..... 102/22–24

[56] References Cited

U.S. PATENT DOCUMENTS

| | | | |
|---|---|---|---|
| 2,886,424 | 5/1959 | Hyslop, Jr. | 102/23 |
| 2,920,523 | 1/1960 | Barco et al. | 102/23 |
| 3,035,519 | 5/1962 | Barlow | 102/23 |
| 3,482,515 | 12/1969 | St. Clair | 102/23 |
| 3,768,411 | 10/1973 | Maes | 102/24 |

*Primary Examiner*—Verlin R. Pendegrass

*Attorney, Agent, or Firm*—Brumbaugh, Graves, Donohue & Raymond

[57] ABSTRACT

A blasting method uses liquid oxygen and a fluid fuel selected from the cryogenic fuels (liquefied methane, ethane and propane), acetylene and carbonaceous materials (such as fuel oil and powdered coal). A shock force is imposed on the blasting agent to initiate detonation or fluid-fluid explosive self-mixing or both detonation and explosive self-mixing of the fuel and LOX (depending on the fuel). The LOX and the cryogenic fuels (when used) are conducted from safely remote sources through cryogenic fill lines into cryogenic containers in the blast holes, which keep the cryogenic fluids out of thermal contact with the ambient temperature materials in and around the blast hole. The containers and at least the parts of the fill lines near enough to the hole to be damaged or destroyed by the blast are made from closed cell plastic foam, a readily available, cheap, disposable material.

9 Claims, 1 Drawing Figure

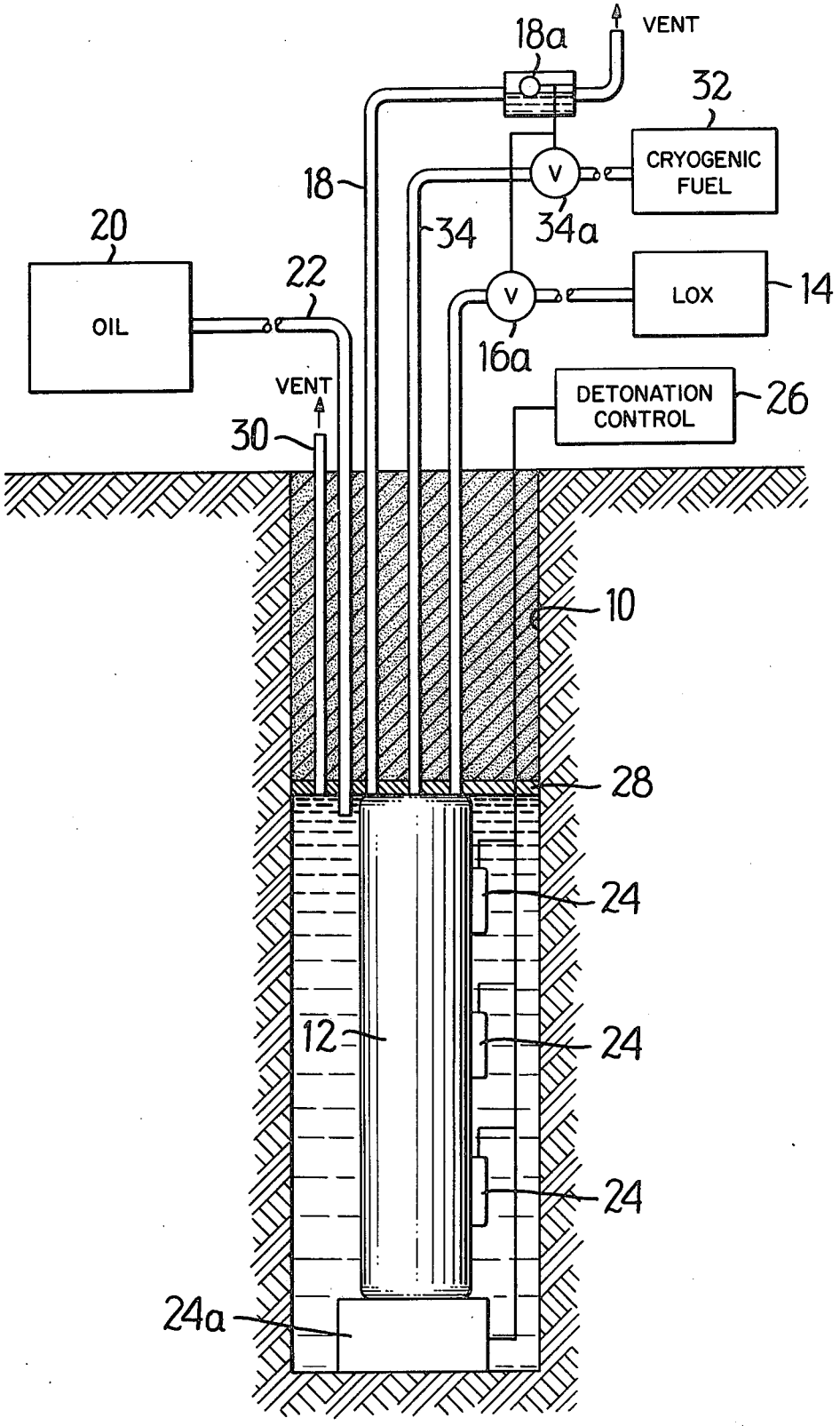
18a
VENT
32
CRYOGENIC FUEL
V
34a
18
34
20
OIL
22
V
LOX
14
16a
VENT
DETONATION CONTROL
26
30
10
28
24
12
24
24
24a

BLASTING AGENT AND METHOD

BACKGROUND OF THE INVENTION

This application is a continuation-in-part of application Ser. No. 590,489 filed June 25, 1975, and now abandoned.

The blasting or breaking of rock has become relatively less expensive as cheaper, and sometimes more effective, blasting agents have been developed. Black powders were used before the advent of nitroglycerine and, later, the less sensitive form of nitroglycerine, "dynamite," was introduced. In the 1950's, blasting agents composed of "prills" and oil, i.e., dehydrated ammonium nitrate (fertilizer) and oil, were developed and have become the cheapest and most commonly used blasting agent, particularly in open pit mining. The particular combination of oxygen-fuel oil jet piercing and prills and oil as the explosive was responsible for the economic development of the taconite iron ore bodies. The competition for ever cheaper blasting agents seems to have culminated in prills and oil for several reasons. The vast tonnage of fertilizer produced keeps production costs down, and the relative insensitivity of prills to detonation allowed it to be shipped in bulk with minimum precautions. The Texas City disaster in 1947 somewhat modified the thinking about precautions in shipping and handling, but prills is normally considered to be one part of a two-part explosive, with the addition of light oil being the first level of sensitization and the addition of slurries of nitro-methane and powdered aluminum a further sensitization. Those additions are frequently performed at the time of use to lessen the danger in transportation.

The considerations discussed above had some bearing on the use around the turn of the century of another relatively cheep explosive, mixed liquid oxygen and a solid fuel, such as carbon black or sawdust. The heat loss in the hole in the time interval between filling and detonation, as well as other cryogenic problems, caused the abandonment of that development. In mixing with liquid oxygen ambient temperature fuel, fuel oil or powdered coal in the hole, the liquid oxygen (hereinafter referred to as "LOX") boiled off in cooling the fuel alone will be roughly 1.5 times the LOX required for the explosive, so that cooling and mixing in the hole is economically unattractive. An exception to this, as described below, is the use of methane, ethane or propane as fuels, which can enter the hole as a liquid a few degrees above LOX — methane solidifies at about the LOX temperature, and ethane at a slightly lower temperature. McKinley (in U.S. Pat. No. 2,939,778) has shown that LOX and liquid methane, ethane or propane are mutually soluble at ratios that extend from above to below stoichiometric, i.e., fuel rich or lean, so that detonatable mixtures can be made over a wide range and that the safe handling of these mixtures outside the blast hole requires that no flammable vent gas is emitted. He teaches that this can be accomplished by maintaining the explosive solution at a temperature below a critical temperature by an external cooling system. The complexity and danger has excluded application of the McKinley techniques, but in the present invention the filling is from sources remote from the blast hole and mixing is performed in the blast hole so that an accidental ignition of the vent vapor is not a safety problem. Because of the wide range of detonatable mixtures, the possibility exists of initiating detonation in the cryogenic solution with as little as 20% of stoichiometric fuel — i.e., 80% oxygen rich and utilizing fuel oil in a secondary container to complete the explosion at lower rate of burn by fluid-fluid explosive self-mixing.

Various explosive systems and methods employing LOX have been proposed heretofore. According to one such proposal, the hole is loaded with a powdered fuel, the fuel is precooled with liquid nitrogen, and LOX is pumped in. The precooling step involves unacceptably high costs for the liquid nitrogen used, and substantial LOX boil-off is unavoidable in a practical blasting operation involving numerous blast holes. The elaborate equipment required in such an operation further diminishes its practical value.

The great hazard of mixtures of LOX and fuels, which has long been recognized, has led to proposals that purportedly reduce the hazard. None of the proposals has been accepted commercially, probably because the hazards have not been reduced to an acceptable level or the costs of the allegedly safer systems have been higher than other explosive systems.

There are, however, several theoretical advantages to the use in blasting of LOX and the common fuels, e.g., powdered coal or fuel oils, or the cryogenic fuels, e.g., liquefied methane, liquefied ethane and liquefied propane, or both. For one thing, the blasting cost per unit of energy released can be significantly less than presently used explosives by a factor of from two to as much as eight. Moreover, the energy per unit volume of drill hole is larger — in the case of prills and oil by a factor of 2.3 to 2.5 — and allows, therefore, the use of a correspondingly smaller hole for the same blast effect.

Inasmuch as the costs of drilling and blasting are a significant fraction of the total mining costs — the breakdown is usually considered to be about 1/3: 1/3: 1/3 for drilling, blasting and mucking underground and about 1/6: 1/6: 2/3 for open pit operations — a major cost leverage still exists for developing a cheaper, more effective blasting agent.

There are four primary considerations for an effective, improved blasting agent. These are:

1. The highest energy and pressure release per unit volume with a variable rate covering the range high order detonation to low order burn.
2. Absolute safety against accidental ignition from spills, electricity, etc.
3. The materials must cost less than other explosives.
4. A down hole residence time long enough to permit filling and near simultaneous detonation of a large number of holes.

The reasons for consideration number (1) are: (1) the cost of drilling the hole is about equal to the cost of the explosive so that a more powerful explosive per unit volume means that a smaller and hence cheaper hole can be used; (2) the variable energy release rate is needed for open pit mining — a high order detonation creates a shock wave which fractures the rock, and the lower order (slower) burn releases a gas pressure which heaves or lifts the fractured rock as a semi-fluid and lets it fall back in a fashion optimum for loading. Hence any useful explosive for open pit work must have a means of obtaining a variation of energy release rate.

The safety requirements (consideration 2) for all industrial operation are becoming increasingly stringent, and explosives are no exception. The reasons for low cost and protracted down hole residence times (3 and 4 above) are obvious.

SUMMARY OF THE INVENTION

There is provided, in accordance with the present invention, a method of blasting that offers a significant cost advantage on a per unit of energy basis, and is safe (within the context of explosives technology). The method employs liquid oxygen ("LOX"), a fluid fuel (the term "fluid"is used in a broad sense to refer to liquids, particulate solids and solids that become fluid under the conditions prevalent in use) and a booster charge for initiating "fluid-fluid explosive self-mixing" of the liquid oxygen and fuel.

The fuels of the blasting agent may be either the common fuels, such as powdered coal or fuel oil, or the cryogenic fuels, liquid methane, liquid ethane, and liquid propane. Acetylene can also be used by precooling it in a liquid nitrogen or dry ice cooler, but will generally be used only in very unusual cases where extremely high energy density is needed. In no case are the LOX and fuel premixed before putting them in the blasting hole, and when oil or powdered coal is used as the fuel, the LOX is contained separately in the hole.

Instead, according to the invention, the LOX constituent is conducted from a safely remote source through a cryogenic fill pipe into a cryogenic container in the hole. When cryogenic fuels are used, they are also piped from safely remote sources through cryogenic lines into either the LOX container or into another cryogenic container. The containers for the LOX and cryogenic fuels (when cryogenic fuels are used) are made of a closed cell plastic foam that is of a type in which the cells contain a gas that solidifies when cooled to LOX temperature, thus leaving a vacuum in the cells when in use. Preferably, the containers are reinforced with paper, fiberglass scrim or some other low-cost material. Polyethylene is, at present, the lowest cost closed cell foam available and is commonly made by foaming with Freon which solidifies at LOX temperature. In the manufacture of such foam, the Freon generally leaks out during storage in several weeks. Therefore, for optimum insulation properties, the manufactured foam fill lines or containers may have to be bagged and stored with Freon or $CO_2$, both of which are inert but solidify rapidly at LOX temperature. Paper-backed polyethylene foam sheet is thus preferred at present, is currently available at low cost in view of its widespread use in, for example, protective mailing envelopes. Containers of such material are easily fabricated by heat sealing techniques. The foam walls of the containers need be only about 1/16 to ⅛ thick to provide economically acceptable boils offs during useful filling times. The paper and foam are also fuels and are consumed in the explosion. The containers are disposable, in the sense that their cost is far outweighed by the lower costs on an energy unit basis of LOX and fuel (as compared to prills and oil), and the lower costs of the smaller blast holes needed for LOX-fuel explosives, as compared to the holes needed for prills and oil explosions of comparable energy.

The parts of the cryogenic fill lines near the holes will, of course, be destroyed or damaged by the blast; therefore, least the parts of the fill lines near enough to the hole to be lost in the blast are made of closed cell plastic foam materials of the types described above. The parts of the fill lines that can be reused may be either closed cell plastic foam pipes or any conventional cryogenic pipes — the relative cost is likely to be the chief factor in the selection.

The cryogenic fuels are preferably placed in the LOX vessel, in which case there is usually mixing of LOX and cryogenic fuel during filling, although they may be placed in separate, cryogenic vessels, in separate compartments of a single vessel, or filled in sequence to minimize mixing.

The mechanism by which non-mixed LOX-fuel explosives used in the method explode, "fluid-fluid explosive self-mixing," involves a phenomenom that takes place when two materials at greatly different temperatures or two materials that are highly chemically reactive are brought together under certain conditions, which may range from merely placing one of the materials in contact with the other to the imposition of a shock force causing rapid, forced initial mixing of one material with the other. Fluid-fluid explosive self-mixing might perhaps best be described by some well-known examples.

In foundries, a violent explosion can take place when molten slag or metal, such as iron or aluminum, is accidentally poured into water. The molten material and water mix and generate steam explosively. The explosion that occurs when sodium reacts with water is another example.

In these and other cases, an "explosion" means — and even demands — that one fluid mix on a micron particle size level with the other fluid during the time when the energy of one is exchanged with the other, i.e., within the explosion time. The explosion time may be very short, a matter of milliseconds, and the mixing of the fluids is highly efficient and rapid. The pressure generated by the rapid and violent release of energy resulting from either a large thermal temperature difference or a chemical difference between the fluids is the mechanism by which the two fluids are driven into and through one another and self-mix explosively, the rapid mixing progressively creating additional, equally rapid energy release that propagates the explosion rapidly through the entire composite mass of the thermally or chemically reactive materials.

In the case of liquid oxygen and a common fluid fuel, such as oil or powdered coal, the rates of energy release and pressure build-up are very large and, therefore, the mixing is rapid and thorough. With cryogenic fuels, even higher rates of pressure build-up and energy release, which approach or become a detonation wave, are obtained.

When the blasting agents consist only of LOX and one or more cryogenic fuels mixed in the hole in a cryogenic container, the blast will be largely or totally a detonation rather than a fluid-fluid explosive self-mixing burn. When the blasting agents comprise both mixed LOX-cryogenic fuel in the cryogenic container and fuel outside the container, the blast consists of both detonation (of the LOX-cryogenic fuel) and fluid-fluid explosive self-mixing (of LOX and the outside fuel, e.g., powdered coal or oil or a separately contained cryogenic fuel).

The advantages on a price per unit energy basis and a price per unit volume basis of a LOX-fuel reaction, as compared to an ammonium nitrate — hydrocarbon reaction, are apparent from a comparison of the chemical reactions involved. To make ammonium nitrate requires in terms of energy the equivalent of approximately two ($CH_2$). When ammonium nitrate is detonated alone, it releases an energy equivalent to about ½ ($H_20$) and one free oxygen. When the oxygen is combined with a stoichiometric quantity of oil, i.e., about ⅓

($CH_2$), the final energy per molecule of ammonium nitrate is equivalent to about 0.57 ($CH_2$) if the latter were combined with the oxygen. Therefore, the use of ammonium nitrate as an explosive medium involves the use of at least 2 ($CH_2$) units to make the ammonium nitrate necessary to obtain the explosive energy of 0.57 ($CH_2$).

On the other hand, the separation and liquefication of oxygen require only about 0.2 ($CH_2$) for the oxygen necessary to burn about one ($CH_2$). The net difference in fuel required to produce one unit of explosive energy is approximately 12 fold as between LOX and ammonium nitrate. At current bulk prices of ammonium nitrate, liquid oxygen and fuel oil, blasting agents, according to the present invention, offer an advantage of being as low as about one-eighth of the cost of prills and oil for the same explosive energy.

DESCRIPTION OF EXEMPLARY EMBODIMENT

The accompanying drawing is a generally schematic cross-sectional view of a LOX-fuel blasting agent placed in a blast hole.

Reference numeral 10 in the drawing designates a blast hole such as might be formed in an open pit mining operation. In a typical blasting operation many such holes are made, charged with explosive and then set off simultaneously.

A cryogenic vessel 12 is placed in the bottom of the hole and is filled from a safely remote source 14 with LOX shortly before detonation. Preferably, the cryogenic vessel 12 is a bag or cylinder made of a closed cell, Freon-blown polymeric foam, such as polyethylene, reinforced with paper or fiberglass scrim. The LOX is conducted into the vessel 12 through an insulated fill pipe 16, which is also, preferably, made of polyethylene foam or some other closed cell polymeric foam material. Oxygen that boils off during filling and holding is vented through a vent pipe 18 (also foam) leading from the vessel 12. (Filling is discussed further below.)

The annular space in the blast hole 10 surrounding the vessel 12 is filled with a fluid fuel, such as oil or powdered coal, delivered from a source 20 through a fill pipe 22. A vent pipe 30 leads from the annular space to above the ground for venting air during filling of the annular space with the fluid fuel. The relative volumes of the annular space and the vessel 12 are selected to provide substantially stoichiometric amounts of liquid oxygen and fuel. The placement of the blasting agent may involve first filling the vessel 12 with a small amount of liquid nitrogen to lower the temperature of the vessel, to solidify the plastic and prevent the vessel from collapsing when oil is introduced around it at the same time that it is being filled with LOX.

An initiator in the form of one or more explosive charges 24, which may be sticks of dynamite or a mass of blasting "gel, " is appropriately placed adjacent the blasting agent and is connected to a detonator control 26. The blasting agent is covered by a top plate 28, such as a plywood, disk, and stemming material is placed in the drill hole to the surface.

In open pit mining, it is desirable that the shock wave and the rate of energy release be higher at the bottom of the hole than at the top to fracture and break the "toe, " i.e., the bottom of the bench. The rest of the charge, and the major part of the energy, are needed to lift the entire mass of rock after the toe is partially broken out. As the rock falls back, it breaks into a size distribution that is optimum for loading. If the shock from the explosion is too strong, the rock is pulverized, and a "sweeping" operation for loading becomes more difficult. Accordingly, in most cases, a relatively slow explosive with a relatively weak shock is suitable. In harder rock, of course, a stronger shock is desirable. With blasting agents made and used according to the present invention, the blasting properties are controlled, in part, by the type, size, number and geometric placement of initiator charges, inasmuch as the magnitude and placement affect the speed of explosive self-mixing of the liquid oxygen and fuel and, therefore, the rate of pressure build-up. Thus, a strong initiator charge **24*a* may be placed at the bottom of the hole below the cryogenic vessel to kick out the toe, and a number of weaker initiator charges 24** may be suitably placed along the length of the vessel, as shown in the drawing.

The drawing also illustrates the use of alternative blasting agents, namely those composed of LOX and a cryogenic fuel alone or in combination with a common fuel such as oil. In particular, blasting agents, according to the present invention, that provide a stronger shock than LOX and oil comprise one or more of the cryogenic fuels, liquefied methane, liquefied ethane and liquefied propane. Preferably, the cryogenic fuel is conducted from a safely remote supply tank 32 into the foam vessel 12 through a foam fill line 34. In the course of filling the vessel, which, of course, is carried out just prior to ignition of the blasting agent (to minimize boil off), the LOX and fuel mix, the extent of mixing depending to some extent on the filling procedure. The strength of the shock produced upon fluid-fluid explosive self-mixing of the LOX and fuel will depend in such cases not only upon the form and placement of initiator charges but on the extent of mixing of the LOX and fuel. With good mixing to provide a generally homogenous blending, a relatively stronger shock is produced. The greater the degree to which the fuel and LOX are separated, the weaker the shock but, in most cases, blasting agents composed of LOX and cryogenic fuels will create a stronger shock then blasting agents composed of LOX and oil. In some cases, it may be desirable to provide separate cryogenic vessels, usually plastic foam bags, one for the LOX and one for the cryogenic fuel, but ordinarily, both the LOX and cryogenic fuel will be contained in a single vessel, and will be mutually dissolved upon filling. In this case, the strength of the shock produced in detonation will depend upon how lean is the solution of LOX and cryogenic fuel. The remaining oxygen will be consumed by fluid-fluid mixing with the appropriate separately contained fuel. Thus the ratio of dissolved to separately contained fuel and the number and disposition of initiator charges will control the shock to a slower burning explosive.

The filling of the foam container (or containers) with LOX and cryogenic fuel (when used) is best controlled by valves **16*a* and 34*a* in the fill lines which are actuated in response to a float control 18*a* in the vent line 18 (which should also be of foam), as illustrated schematically in the drawing. Complete filling of the container is thus ensured in that liquid return in the vent pipe 12 and lifting of the float 18*a* indicates that the cryogenic vessel 12 is full, the valves 16*a* and 34*a*** thereupon being closed.

Relatively small amounts of cryogenic fuel can be added to the LOX in the vessel 12 and additional fuel such as oil used in the manner depicted in the drawing for the balance of the fuel part of the blasting agent.

With blasting agents containing both a cryogenic fuel and an oil, the strength of the shock is significantly greater than when oil is used alone, but the cost advantage of using oil as a fuel in the blasting agent is largely retained. In a sense, the cryogenic fuel added to the LOX is a form of booster, in that it increases the rate of explosive self-mixing of the LOX and oil.

A very strong explosive shock is provided, in accordance with the invention, by using acetylene as the principal fuel of the blasting agent. Acetylene is chilled and then either put in the cryogenic vessel with the LOX, in which case the acetylene will be in crystalline form or can be put in the space between the cryogenic vessel and the wall of the hole. Fluid-fluid explosive self-mixing of the liquid oxygen and acetylene are initiated in the same way as in other forms of the blasting agents, as hereinbefore described.

From the foregoing, it is apparent that the fuel ingredients of the blasting agents, according to the present invention, may be used in various proportions and various combinations which each other to control the explosive properties.

The blasting agents of the present invention may, of course, be used in below-ground blasting. In such use, it will often be desirable to make the blasting agent oxygen-rich to ensure that only carbon dioxide and water result from the reaction of the LOX and fuel. An important advantage of the blasting agent in below-ground blasting is, indeed, the lack of any toxic material resulting from the explosion of the blasting agent. Accordingly, ventilation in the mine can be reduced significantly, say by an order of magnitude, and the lost time in purging the mine of toxic gases after a blasting operation, which is unavoidable when most blasting agents are used, is eliminated.

I claim:

1. A method of blasting comprising the steps of placing a cryogenic container of closed cell plastic foam in a blast hole, placing at least one fluid fuel in the blast hole, conducting liquid oxygen into the container from a source safely remote from the blast hole through a cryogenic fill line, at least the part of the fill line near the hole being of closed cell plastic foam, and setting off at least one initiator charge in the blast hole to initiate detonation or fluid-fluid explosive self-mixing or both detonation and fluid-fluid explosive self-mixing of the liquid oxygen and fuel.

2. A method according to claim 1 wherein the fuel is a cryogenic fuel selected from the group consisting of liquid methane, liquid ethane, liquid propane and combinations thereof and is placed in the cryogenic container by conducting it through another cryogenic fill line, at least the part of the fill line near the hole being of closed cell plastic foam, from a source safely remote from the blast hole.

3. A method according to claim 2 wherein the cryogenic fuel is placed in a second cryogenic container of closed cell plastic foam placed in the blast hole.

4. A method according to claim 1 wherein the fluid fuel is a member selected from the group consisting of oil, powdered coal and combinations thereof and is placed in the blast hole outside the cryogenic container.

5. A method according to claim 1 wherein the fluid fuel is acetylene and further comprising the steps of cooling the acetylene and conducting it into the cryogenic container.

6. A method according to claim 1 and further comprising the step of venting the cryogenic container through a cryogenic vent line of closed cell plastic foam, detecting the physical state of the substance passing through the vent line and controlling the flow of liquid oxygen through the fuel line in accordance with such detection to maintain flow of liquid oxygen through the fill line when the physical state is gaseous and to stop flow through the fill line when the physical state is liquid.

7. A method according to claim 1 wherein a first relatively stronger initiator charge is placed in the blast hole below the container and a multiplicity of relatively weaker initiator charges are placed at selected elevations in the blast hole.

8. A method of blasting comprising the steps of placing a relatively stronger initiator charge in the bottom of a blast hole, placing a cryogenic container of closed cell plastic foam in the blast hole above the relatively stronger initiator charge, the container having a volume substantially less than the volume of the blast hole to leave an annular space between the walls of the container and the walls of the blast hole, placing a multiplicity of relatively weaker initiator charges at selected elevations in the annular space, introducing a fluid fuel into the annular space from a source safely remote from the blast hole, conducting liquid oxygen into the container through a cryogenic fill line, at least the part of the fill line near the hole being of closed cell plastic foam, from a source safely remote from the blast hole and setting off the charges to initiate fluid-fluid explosive self-mixing of the fuel and liquid oxygen.

9. A method according to claim 8 further comprising the step of conducting a cryogenic fuel into the container from a source safely remote from the blast hole through another cryogenic fill line, at least the part of the fill line near the hole being of closed cell plastic foam.

* * * * *